United States Patent [19]

Blodgett et al.

[11] 4,448,095

[45] May 15, 1984

[54] RATCHET WRENCH

[75] Inventors: Richard E. Blodgett, Basking Ridge, N.J.; Ervin J. Furedi, 223 Pleasant Grove Rd., Long Valley, N.J. 07853

[73] Assignee: Ervin J. Furedi, Long Valley, N.J.

[21] Appl. No.: 355,529

[22] Filed: Mar. 8, 1982

Related U.S. Application Data

[63] Continuation-in-part of Ser. No. 083,380, Nov. 10, 1979, Pat. No. 4,318,314.

[51] Int. Cl.[3] ..... B25B 17/00

[52] U.S. Cl. ..... 81/57.29; 81/58.1; 81/62

[58] Field of Search ..... 81/57.29, 62, 63, 58.1, 81/58; 192/43, 43.1, 43.2, 45.1

[56] References Cited

U.S. PATENT DOCUMENTS

| | | | |
|---|---|---|---|
| 2,703,030 | 3/1955 | Marvin | 81/58.1 |
| 3,372,781 | 3/1968 | Fulton | 81/58 |
| 3,659,484 | 5/1972 | Scodeller | 81/63 |
| 3,952,617 | 4/1976 | Degg | 81/62 |
| 4,086,829 | 5/1978 | Hudgins | 81/57.29 |
| 4,128,025 | 12/1978 | Main et al. | 81/58.1 |
| 4,318,314 | 3/1982 | Furedi et al. | 81/57.29 |

*Primary Examiner*—James L. Jones, Jr.

[57] ABSTRACT

In a preferred embodiment, gear drive mechanism includes a non-driving space in reversing direction of rotation of the handle of ratchet wrench, within that interval providing for handle engagement with a toggle-type switch for reversing ratcheting direction, handle engagement of ratcheting mechanism being by way of a handle twistable out of alignment with mounting structure of the handle portion of the wrench such that non-circular circumscribing inside wall surfaces of the handle as viewed in transverse cross-section, engages and wedges a roller against the rounded surface of the drive shaft whereby while the roller is wedged, reverse direction turning of the handle causes the drive shaft to turn to thereby flip the toggle-like switch mechanism reversing the ratcheting direction of the ratchet wrench.

13 Claims, 10 Drawing Figures

RATCHET WRENCH

This is a continuation-in-part of Ser. No. 083,380, filed Nov. 10, 1979, now U.S. Pat. No. 4,318,314.

This invention is directed to a ratchet wrench having an improved mechanism of drive of ratchet-reversing mechanism and of the mechanism of ratchet reversal.

BACKGROUND TO THE INVENTION

Prior to the present invention and the copending parent application U.S. Ser. No. 083,380 having issue date Mar. 9, 1982 as U.S. Pat. No. 4,318,314 the disclosure of which is hereby incorporated by reference in its entirety, the reversal mechanisms of ratcheting of ratchet wrenches has always necessitated a separate and distinct reversal switch apart from the normally-gripped handle of the ratchet wrench, and the handle of the ratchet wrench revolved during a non-driving ratcheting stroke of the shaft and handle of the prior art ratchet wrenches. A typical prior art patent illustrating the above-noted turning (revolving) of the handle during the ratcheting stroke of oscillation is U.S. Pat. No. 4,086,829 dated May 2, 1978 to Hudgins. Both that prior art patent and also the U.S. Pat. No. 3,372,781 dated Mar. 12, 1968 to Fulton illustrate the use of separate switches for reversing direction of ratcheting, the action being by force transmission by other than the normal drive shaft of the ratchet wrench. There has therefore been present the difficulty of properly retaining a tight grip on the handle when it rotates during ratcheting, together with necessity of a two-hand operation—one to hold the wrench and the other to flip the separate button or switch apart from normal handle gripping. Also, as compared to the force-transmitting mechanism in the head of the ratchet wrench of the prior parent application above-noted transmitted through the pawl itself, and likewise as compared to the torque of the parent application handle mechanism through a spring-structure thus requiring a sturdy spring structure to endure against breakage of the spring when subjected to large forces, the invention of the present application deals with such disadvantages and difficulties.

BROAD DESCRIPTION

Accordingly, the present invention includes as an object, the obtaining of an improved ratchet wrench overcoming one or more of the preceding problems and difficulties.

Another object, more specifically, is to obtain a ratchet wrench having a ratchet mechanism reversible by reverse twisting and turning of the handle of the ratchet wrench.

Another object is to obtain preceding objects together with greater strength and sturdiness of driving mechanisms thereof.

Another object is to obtain a ratchet wrench having head gearing drive mechanism of improved strength and sturdiness.

Another object is to obtain a ratchet wrench with a novel mechanism of drive of the drive shaft rotatably upon a rotating of the handle thereof.

Another object is to obtain above-noted objects, together with a female ratchet member of improved strength and sturdiness.

Other objects become apparent from preceding and following disclosure.

One or more objects of the invention are obtained by the invention as disclosed herein, as diagrammatically illustrated typically by the Figures.

Broadly the invention may be described as a novel ratchet wrench typically inclusive of a general and continuous support structure supporting the handle, drive shaft, gearing and driven socket stud and support structure thereof, one improvement being a mechanism such that concurrently the handle is free from revolving connection during a ratcheting stroke of the handle and shaft, while the ratchet reversal switch is actuatable by initial reverse twisting and rotation of the handle of the ratchet wrench. Another improvement includes a toggle-switch mechanism actuatable by the head gears upon the initial reverse twisting and revolving of the handle of the ratchet wrench. Another improvement arises in the line of direct force transmittal by the stationary gears in their interconnection with the support structure of the socket stud of the ratchet wrench. Another improvement arises in a novel mechanism of force-transmittal from the handles inside irregularly-shaped circumscribing surface as viewed in transverse cross-section through the handle, through a wedgable roller by the wedging of the roller against the rounded shaft of circular cross-section as viewed in transverse cross-section therethrough, when the handle is twisted and revolved in a non-driving ratcheting direction of rotation. Another improvement is in a novel drag-mechanism and mechanism for permitting the handle to be twisted off-center alignment with the handle support structure, such that the wedging and gripping operation is thusly initiated such that the handle drives through the wedged roller, the round drive shaft.

Preferably the wedging structure includes paired adjacent oppositely slanted surfaces as surface portions of the inside irregularly-shaped surface of the handle as previously discussed above. A broad range for an angle formed between an imaginary line of extension of one of the slanted surfaces and an opposing converging imaginary horizontal line that is vertical to a perpendicular taken through the center diameter of the roller in a wedged state, ranges between about 7 degrees and about 12.5 degrees, but for preferred non-slipping engagement even if slightly soiled with oil or the like, a preferred range from about 9 degrees to about 11 degrees.

Preferably the dragging composition and concurrently the composition that permits the handle to twist out of alignment with the handle support structure, is rubber, and preferably in the form of an O-ring. By saying rubber is meant any suitable elastic material or composition. The drag serves as a braking composition and function thereof, facilitating the ability of the twisted and revolved handle in the non-driving reverse direction, to grab with its slanted surface the surface of the roller thusly effecting (achieving) the wedging operation of the ball or roller between the slanted surface and the rounded shaft surface against which the roller is normally mounted. Accordingly, while the roller normally revolves when the rounded shaft revolves, the roller is not normally in wedging state of relationship with the handle except when the handle is reversely twisted and revolved. Once the wedged state has been achieved, continued reverse turning continues to cause the rounded shaft to revolve. It is to be naturally understood that what is termed the reverse direction of revolving is dependent upon at any given moment which opposite direction therefrom is the driving-direction— which depends on which currently is the ratchet state of ratcheting of the ratchet wrench. If it is in a clockwise driving state, then reverse direction is counterclockwise. On the other hand, if it is in the counterclockwise driving state, then the reverse direction is clockwise.

The invention may be better understood by making reference to the following Figures. It is particularly pointed out that the drawings of the Figures are not to scale and are not engineering drawings, and are not representative of necessarily exact size and position relationships; instead, the drawings are purely diagrammatic in nature, intended to illustrate mechanism, operation, and general shape and function, for improved understanding of the description of the invention. However, the elements illustrated are accurate and operative, this invention having been reduced to practice by actual reduction to practice prior to the filing of this application for patent.

THE FIGURES

Figure 2A:
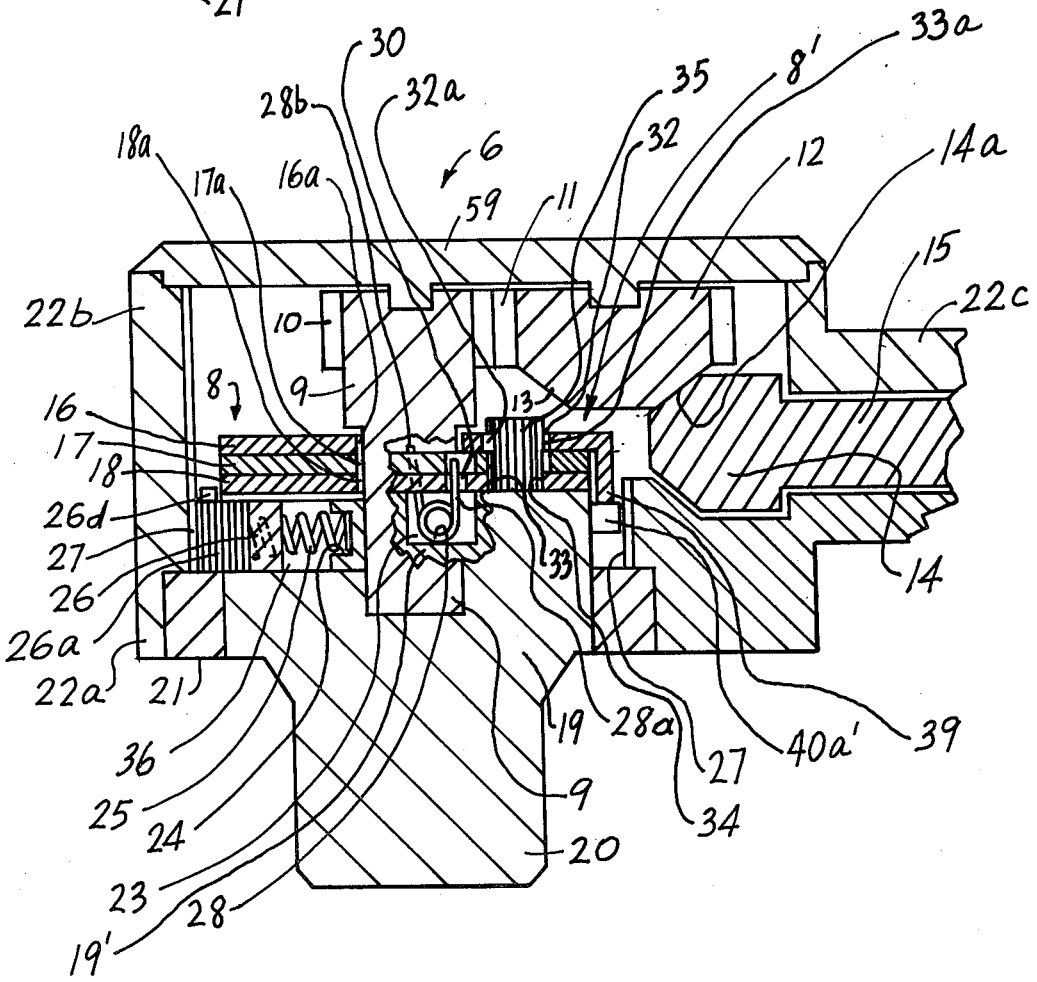
FIG. 2A illustrates a head-end of the FIG. 1 embodiment, as taken along line 2A–2B of FIG. 1, in a side cross-sectional diagrammatic view at the 2A-end of line 2A–2B.
Figure 3A:
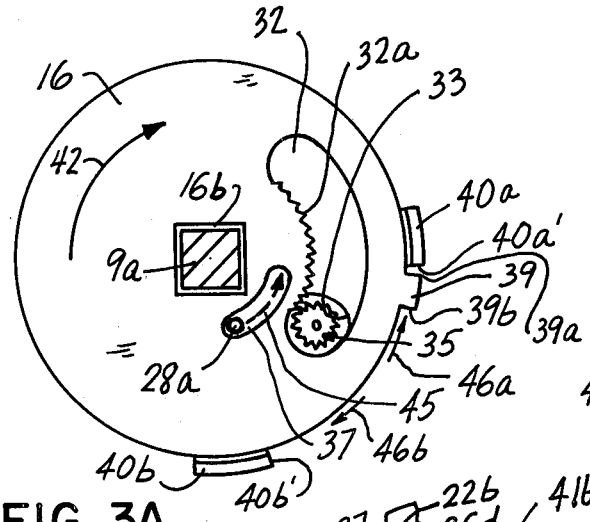

FIG. 2AA illustrates diagrammatically an in-part and cross-sectional view of a portion of structures illustrated in FIGS. 2A and 3A.

Figure 1:
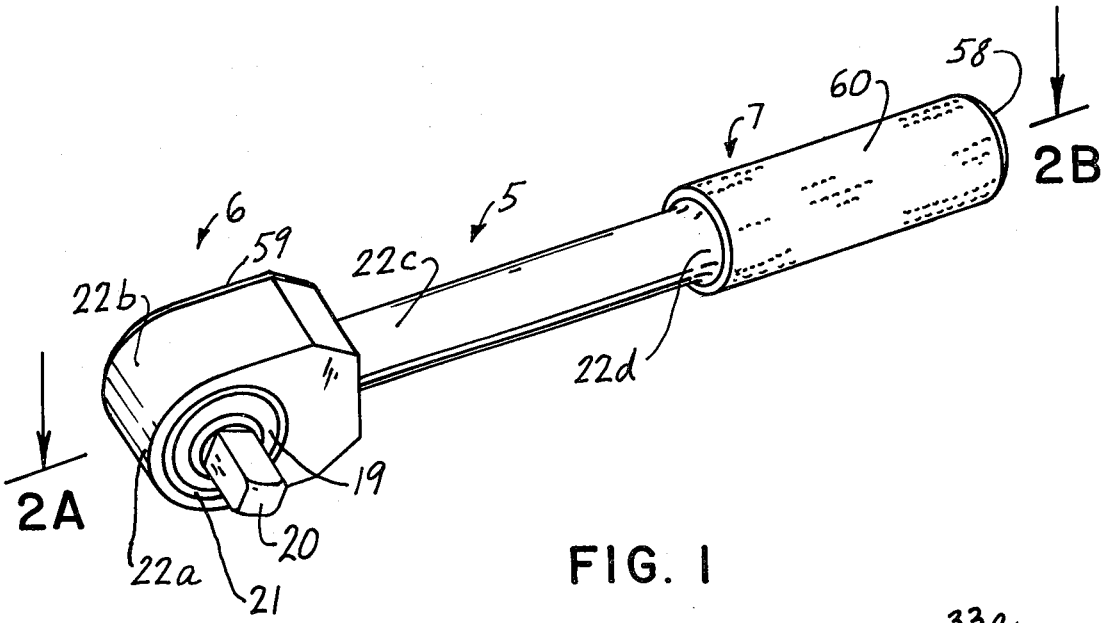
FIG. 1 illustrates an embodiment of the novel ratchet wrench diagrammatically in a bottom and side and end perspective view.
Figure 2B:
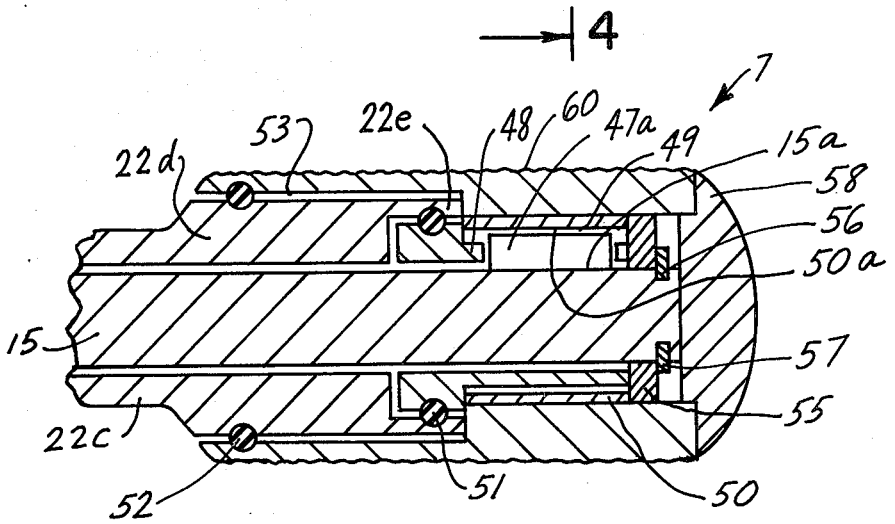

FIG. 2B illustrates diagrammatically a handle-end of the FIG. 1 embodiment, as taken along line 2A–2B of FIG. 1, in a side cross-sectional view at the 2B-end of line 2A–2B.

FIG. 3A illustrates diagrammatically an elevation plan view for the FIG. 1 embodiment, the appearance looking down upon the several plates arranged one on top of the other, of the top plate that is driving-force transmitting in function to the socket stud support structure when revolved by a drive-stroke movement of the handle in the oscillating ratcheting use of the ratchet wrench.

Figure 3B:
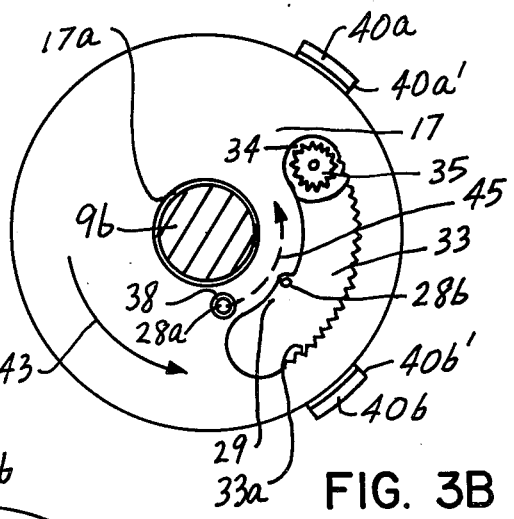

FIG. 3B illustrates diagrammatically an elevation plan view of the FIG. 1 embodiment after removal of the top plate illustrated in FIG. 3A, thus illustrating the upper toggle-switch actuating plate that is rotatedly moved by a gear actuated by teeth on the driving plate of FIG. 3A.

Figure 3C:
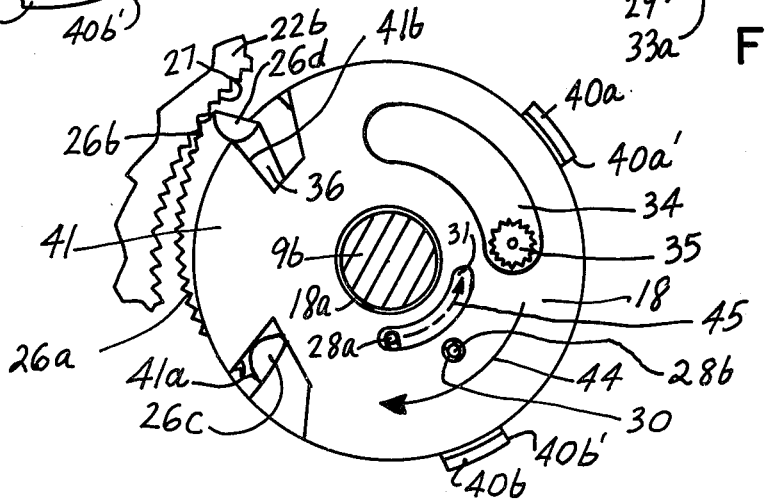
Figure 3D:
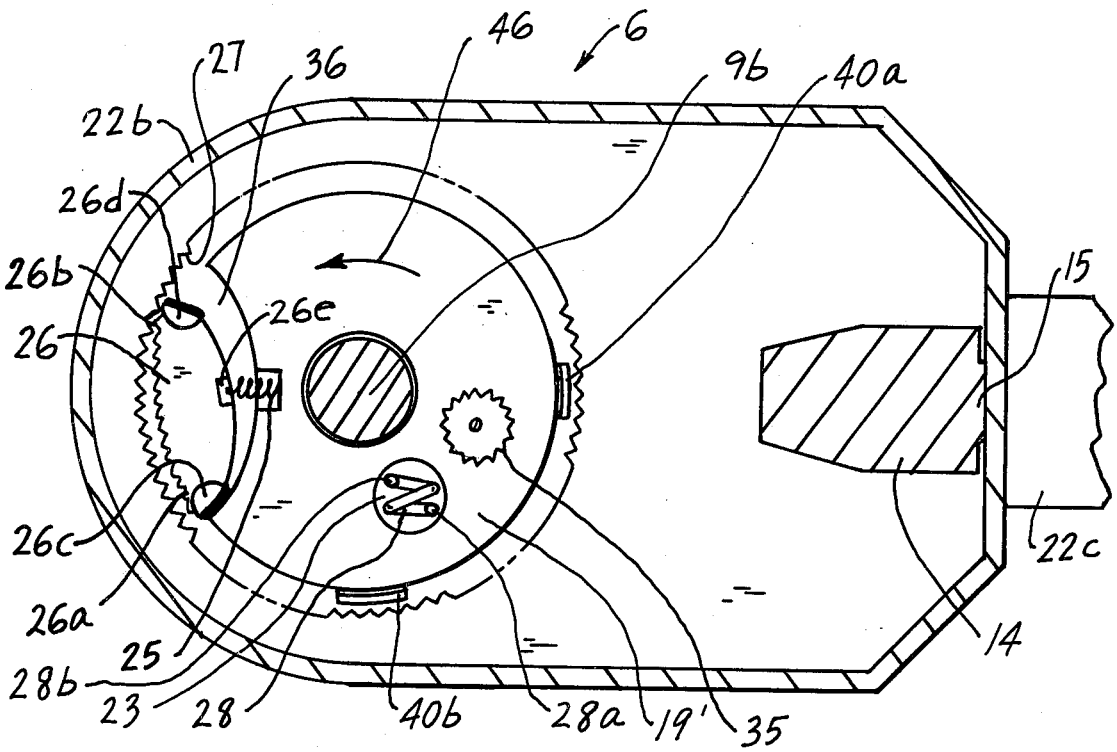

FIG. 3C illustrates diagrammatically an elevation plan view of the FIG. 1 embodiment after removal of the two upper plates of FIGS. 3A and 3B, thus illustrating the lower toggle-switch actuating plate that is rotatably moved by a gear actuated by teeth on the driving plate of FIG. 3A, and part of head support structure. FIG. 3D illustrates diagrammatically a top view of the head-end of the embodiment of FIG. 1, after removal of the top cover-plate and after removal of upper plates of FIGS. 3A, 3B and 3C, thus illustrating the top face of the socket stud-support structure, the mounted gear, the toggle-spring-mounting recess, a cross-section of the plates-mounting shaft, the ratchet pawl positioned in an arced cut-away section of the socket stud-support structure, the biasing spring that is biased against the pawl, the female toothed ratchet surface of the head support structure, and the like.

Figure 4A:
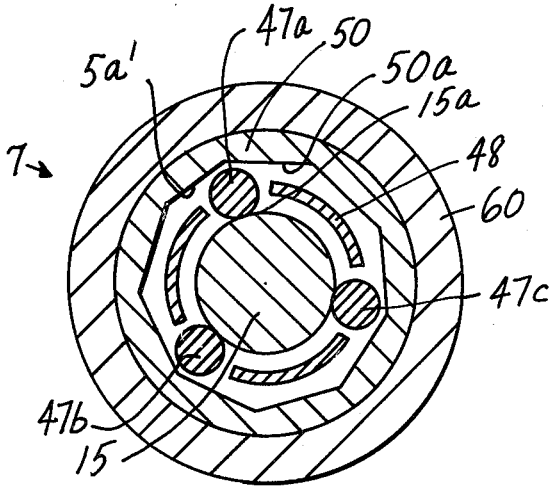
Figure 2A:
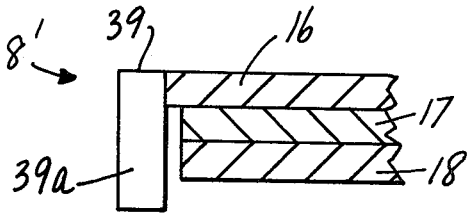

FIG. 4A illustrates diagrammatically a transverse cross-section of the embodiment of FIG. 1, as taken along line 4—4 of FIG. 1, illustrating the rounded drive shaft, the mounted roller and support structure thereof—the barrel structure, and the slanted surfaces of the irregularly-shaped inside surface of the circumscribing surface of the handle as viewed transversely.

Figure 4B:
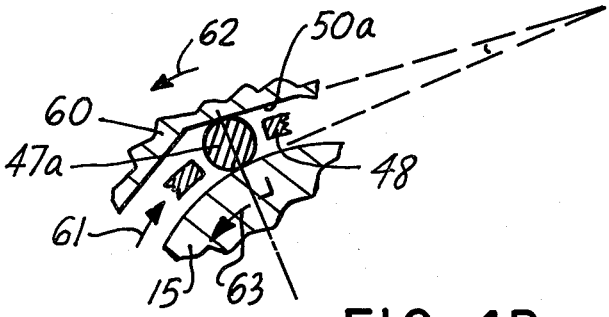

FIG. 4B illustrates diagrammatically the same matters illustrated in FIG. 4A, in an in-part and cross-sectional view but in different positions, in a wedged-state of being, such that a rotation of the handle rotates the drive shaft, and illustrating the angle of the slanted surfaces.

DETAILED DESCRIPTION

FIGS. 1, 2A, 2AA, 2B, 3A, 3B, 3C, 3D, 4A and 4B all illustrate a common embodiment of the invention, and accordingly identical and corresponding indicia are shown in more than one Figure where common elements are illustrated in differing views. Once an indicia in one view has been described, it normally is not repeated for other Figures.

The perspective view of FIG. 1 illustrates broadly the outward appearance of the novel ratchet wrench 5 having a head 6 and a handle end 7.

The FIG. 2A cross-sectional view of the head 6 shows collectively the stack of consecutive plates 8 driven by, directly or indirectly, the shaft 9 and around portions **9*a* and 9*b* thereof as illustrated in FIGS. 3A, 3B, and 3C. Portion 9*a* is squared and has plate 16 with its square hole 16*b* formed by hole plate edges 16*a*, such that plate 16 revolves with the shaft 9. In contrast, each of plates 17 and 18 merely revolve around the rounded portion 9*b* of the shaft 9. The shaft 9 is driven by the teeth 10 being acted upon by teeth 11 of gear element 12 that is driven by action on its beveled teeth 13 by bevel gear teeth 14*a* of bevel gear 14 mounted fixedly upon drive shaft 15. The socket stud 20 is continuous and integral with stud support structure 19. The stud bearing surface 21 of annular shape serves to cushion torque forces of the stud support structure during use, substantially eliminating the possibility of stretching or rupture of support structure portion 22*a*. The head support structure portion 22*b* has the female ratchet teeth 27 on the inside face thereof, and at its upper portion seats the support head top 59**.

Within the circularly-shaped stud-support structure 19 having a substantially flat upper face, there is a recess space 23 in its upper face having spring 28 mounted therein, with its spaced-apart upwardly-extending spring ends **28*a* and 28*b*. A scalloped cut-out space 36 has a coil spring 25 mounted at one end within a recess 24 of the scalloped inwardly located wall of the stud support structure 19, and the other end of the spring is mounted within the pawl recess 26*e* viewable best in FIG. 3D, of the pawl 26. The pawl 26 has, as presently positioned, the non-ratcheting toothed portion 26*a* held in the position shown in FIGS. 2A and 3C and 3D, by the clamping surface 41*a* of the actuating key 41 of plate 18, and the ratcheting toothed portion 26*b*. The clamping surfaces 41*a* and 41*b* respectively act on the pawl heads 26*c* and 26*d* of FIGS. 2A, 3C and 3D**.

FIGS. 2A, 3B and 3C illustrate the aperture 30 having the spring end **28*b* mounted therein. Spring end 28*a* is mounted in the plate aperture 38 best seen in FIG. 3B. Space 37 in plate 16 of FIG. 3A merely provides space for movement of that plate about the spring end 28*a*. Likewise, space 31 in FIG. 3C provides space for movement of plate 18 about spring end 28*a***.

With reference to principally FIGS. 2A, 3A, 3B, and 3C, the plate 16 has cut-out slot 32 with male teeth **32*a*** engaging gear 35, and cut-out slot 33 is also viewable in FIG. 3A; the cut-out slot 33 is in plate 17 through which also slot 34 is viewable, the slot 33 having female teeth 33*a*, in FIG. 3B. Non-toothed mere space-providing slot 34 provides space for plate 18 to move freely about the gear 35. The FIG. 3A plate 16 has a cut-out space 37 providing room for movement of the plate 16 about the spring end 28*a* such as relatively the spring end 28*a* moving in the cut-out space 37 in direction 45 when the plate 16 is driven in direction 42, and in direction 45 when plate 17 forces its movement by plate revolving in direction 43, and the spring end 28*a* moving in direction 45 as plate 18 moves revolvingly in direction 44 which would cause the actuating key 41 to reverse the position of the pawl 26 by the clamping surface 41*b* pressing against head 26*d*. FIG. 3B shows space 29 for movement of spring end 28*b*.

Plate 16 has a downwardly-extending radially outwardly and peripherally-located flange-like key member 39 having opposite force-transmitting faces 39*a* and 39*b* shown in FIGS. 2A, 3A, 3B, 2AA, 3C and 3D, for portions 8' for respectively acting on flange or ridge (rim) structure 40*a* extending outwardly from the stud-support structure, having force-receiving (pressure-receiving) face 40*a'*, and the spaced-apart other flange or ridge structure 40*b* with its pressure-receiving face 40*b'* through which force is transmitted from the plate 16 to drive the stud 20; thus, initial reverse turning of the shaft 9*a* causes the plate 16 through teeth 32*a* to rotate gear 35, which gear 35 rotates plate 17 reversing the position of the spring end 28*a* thereby causing the spring-end 28*b* to also reverse to thusly move plate 18 in direction 44, concurrently causing thereby the actuating key 41 to reverse the direction of the pawl 26 to become spring-biased and clamped in the opposite direction.

The handle end 7 of the ratchet wrench as shown in FIGS. 2B and 4 illustrates the drive shaft 15 against which rollers 47*a*, 47*b* and 47*c* rest mounted with guide space of barrel structure 48. The rollers during normal operation and positioning roll freely with the contacting drive shaft, and do not become wedged against the irregularly-shaped surfaces 50*a* of structure 50 that is tubular in shape and mounted integrally and fixedly with and on the surrounding circumscribing handle structure 60. Even when the handle is gripped and twisted by a person, the rollers do not engage or wedge at the apex locations 50*a'* where angled surfaces converge and meet. However, the twisting of the handle and turing thereof in a non-driving direction of ratching causes the handle structure 60 and structure 50 to be twisted by virtue of yielding elastic O-rings 51 and 52; because the O-rings yield when the handle is twisted, the handle structure 60 moves out of alignment with regard to structure 22*d* which is a part of the support structure, and with regard to the barrel structure 48, whereby the rollers (one or more) become wedged as shown in the FIG. 4B by movement (relatively) in direction 61 by the roller 47*a*, with regard to movement by handle structure 60 and structure 50 in direction 62, thereby driving the shaft in the ratcheting direction 63 (drive shaft 15).

The abutment bearing member 55 of the handle portion 7 in FIG. 2B, of annular shape, serves to hold members onto the drive shaft 15, locked into position by the horse-shoe clamp (pin) 57 with the drive shaft-slot 56. The end plug member 58 merely fits snugly in a wedge-fit as shown, a snap-fit.

For either ratchet position, the ratchet wrench is operated to forcefully manually move the socket stud by the oscillating action with movement of the handle relative to the anchored head portion. The twist of the handle in a ratcheting direction causes the ratcheting-driving functions to reverse, and a continued turning beyond the intermediate reversing phase results in driving in the reverse direction as the new alternate-driving direction, and what heretofore was the driving direction has thusly become the new alternate-ratching direction.

It is within the scope of the invention to make modifications and variations and substitution of equivalents within ordinary skill of the artisan in this field.

We claim:

1. A novel ratchet wrench assembly having selectable ratcheting action to rotate a drive stud in alternately either direction, which comprises: a support structure; a drive stud means including a socket stud, mounted on the support structure; a first gear means fixedly mounted on the support structure for driving said drive stud means; a two-position ratchet means mounted on said drive stud means and including a first ratchet member with one portion positioned and adapted to effect ratcheting action of said drive stud means in one direction relative to an engagable second ratchet member mounted on said support structure, and another portion positioned and adapted to effect ratcheting action in another direction relative to the second ratchet member and a first toggle-spring having one end thereof mounted on the drive stud means and having an opposite end thereof spring-biased against the first ratchet member in an arrangement as to alternately bias the first and second portions into engagement with said second ratchet member; a drive shaft means for drivably engaging said first gear means; a barrel structure rotatable in alternately either of opposite directions and rotatably actuatable of the drive shaft means; first gear clutch means for providing freedom of reverse non-driving movement of said drive stud means, within a predetermined limited range of reverse non-driving movement within which reversing action may take place in direction of drive of the socket stud; and a reversible switch means for reversing in alternately each of opposite directions of driven movement of the drive stud means, said reversible switch means including a spring-biased toggle switch inclusive of a spring element having spaced-apart opposite first and second spring ends and having a central portion rotatably mounted on and movable with said drive stud means, said first spring end being mounted on and movable alternately in opposite directions with said first gear means, said two-position ratchet means including a lever member having a portion thereof freely movable alternately in opposite directions and fixedly mounting said second spring end, to move with the second spring end, and the lever member being in engagement with each of said first and second portions for alternate movement thereof into and away-from engagement with the second ratchet member, whereby alternately reverse-rotatable-turning of said barrel structure shifts said first ratchet member alternately between a first position of ratcheting by the first portion and non-ratcheting of the second portion, and a second position of ratcheting by the second portion and non-ratcheting of the first portion, and whereby concurrently said first gear means beyond said predetermined limited range of freedom of reverse non-driving movement, is reversely drivable of said drive stud means.

2. A novel ratchet wrench assembly of claim 1, including a second clutch means for bi-directionally engaging and optionally driving said drive shaft means in either of opposite directions responsive to rotating said barrel structure whereby rotation of said barrel structure causes the barrel structure to engage and thereby drive said drive shaft means and thus cause said first gear means to drive said drive stud means, said second clutch means concurrently providing for non-engaged non-movement of said barrel structure with said drive shaft means when said support structure is revolved during ratcheting while the socket stud is mounted within a socket.

3. A novel ratchet wrench assembly of claim 2, in which said second clutch means includes at least one roller mounted in rolling-contact with a revolvable driven member of said drive shaft means and with the roller positioned-away from contact with an inside surface of said barrel structure, said barrel structure having said inside surface as viewed in cross-section transversely therethrough with a series of paired slanted surfaces, adjacent slanted surfaces of each pair of slanted surfaces forming a concave angle of a predetermined angle relative to curvature convexly of said revolvable driven member and relative to diameter of said roller, such that one of said adjacent slanted surfaces becomes engaged-with and wedged-against the roller when said barrel structure is rotatedly turned about the drive shaft means.

4. A novel ratchet wrench assembly of claim 3, in which said drive shaft means includes a drive shaft of substantially circular cross-sectional shape transversely thereof, said drive shaft's circumscribing surface being in mounted rolling-contact with said roller, and slant on each of paired slanted surfaces being such that, relative to a perpendicular from a circumscribing surface of said drive shaft as viewed in said transverse cross-section thereof and a horizontal base line vertical to the perpendicular, and further relative to an imaginary linear extension of the slanted surface during engagement and wedging of the roller thereagainst, an occluded angle between the horizontal base line and said imaginary linear extension ranges between about 7 degrees and about 12.5 degrees.

5. A novel ratchet wrench assembly of claim 4, in which said occluded angle ranges between about 9 degrees and 11 degrees.

6. A novel ratchet wrench assembly of claim 5, in which said second clutch means includes a roller-mounting structure substantially free from contact with said drive shaft, revolvably mounted on said support structure.

7. A novel ratchet wrench assembly of claim 6, in which said second clutch means includes a braking-bearing surface-material between and in contact with each of said roller-mounting structure and said support structure such that there exists drag on revolving tendencies of the roller-mounting structure thereby not freely revolvable on the support structure.

8. A novel ratchet wrench assembly of claim 7, including a handle structure revolvable around a portion of the support structure and in fixed-joined contact with said barrel structure, and a braking-bearing surface-material between and in contact with each of said handle structure and said portion of the support structure such that there exists drag on revolving tendencies of the handle structure thereby not freely revolvable around the portion of the support structure.

9. A novel ratchet wrench assembly having selectable ratcheting action to rotate a drive stud in alternately either direction, which comprises: a support structure; a drive stud means including a socket stud, mounted on the support structure; a first gear means fixedly mounted on the support structure for driving said drive stud means; a two-position ratchet means mounted on said drive stud means and including a first ratchet member with one portion positioned and adapted to effect ratcheting action of said drive stud means in one direction relative to an engagable second ratchet member mounted on said support structure, and another portion positioned and adapted to effect ratcheting action in another direction relative to the second ratchet member and a first toggle-spring having one end thereof mounted on the drive stud means and having an opposite end thereof spring-biased against the first ratchet member in an arrangement as to alternately bias the first and second portions into engagement with said second ratchet member; a drive shaft means for drivably engaging said first gear means; a barrel structure rotatable in alternately either of opposite directions and rotatably actuatable of the drive shaft means; first gear clutch means for providing freedom of reverse non-driving movement of said drive stud means, within a predetermined limited range of reverse non-driving movement within which reversing action may take place in direction of drive of the socket stud whereby alternately reverse-rotatable-turning of said barrel structure shifts said first ratchet member alternately between a first position of ratcheting by the first portion and non-ratcheting of the second portion, and a second position of ratcheting by the second portion and non-ratcheting of the first portion, and whereby concurrently said first gear means beyond said predetermined limited range of freedom of reverse non-driving movement, is reversely drivable of said drive stud means.

10. A novel ratchet wrench assembly of claim 9, including a second clutch means for bi-directionally engaging and optionally driving said drive shaft means in either of opposite directions responsive to rotating said barrel structure whereby rotation of said barrel structure causes the barrel structure to engage and thereby drive said drive shaft means and thus cause said first gear means to drive said drive stud means, said second clutch means concurrently providing for non-engaged non-movement of said barrel structure with said drive shaft means when said support structure is revolved during ratcheting while the socket stud is mounted within a socket.

11. A novel ratchet wrench assembly of claim 10, in which said second clutch means includes at least one roller mounted in rolling-contact with a revolvable driven member of said drive shaft means and with the roller positioned-away from contact with an inside surface of said barrel structure, said barrel structure having said inside surface as viewed in cross-section transversely therethrough with a series of paired slanted surfaces, adjacent slanted surfaces of each pair of slanted surfaces forming a concave angle of a predetermined angle relative to curvature convexly of said revolvable driven member and relative to diameter of said roller, such that one of said adjacent slanted surfaces becomes engaged-with and wedged-against the roller when said barrel structure is rotatedly turned about the drive shaft means.

12. A novel ratchet wrench assembly of claim 1, in which said first gear means includes a toothed gear mounted on a drivable shaft fixedly and drivable of the drivable shaft, said gear means being in contact and engagement with and driven by said drive shaft means, a portion of said drivable shaft having fixedly-mounted thereon a driving member having a downwardly-extending end portion, and said drive stud means including spaced-apart key structures, said downwardly-extending end portion being positioned between said spaced-apart key structures and engageable therewith alternately when alternately driving said drive stud means in opposite directions.

13. A novel ratchet wrench assembly of claim 3 or claim 11, including a handle structure revolvable around a portion of the support structure and in fixed-joined contact with said barrel structure, and a resilient braking-bearing O-ring between and in contact with each of said handle structure and said portion of the support structure and positioned such that the handle structure is twistable out of alignment with the support structure when turning the handle structure.

* * * * *